United States Patent [19]

Mukai et al.

[11] Patent Number: 4,470,761

[45] Date of Patent: Sep. 11, 1984

[54] SWASH PLATE TYPE COMPRESSOR

[75] Inventors: Takamitsu Mukai; Kenji Takenaka; Taku Yamamoto; Takashi Ban, all of Aichi, Japan

[73] Assignee: Kabushiki Kaisha Toyoda Jidoshokki Seisakusho, Aichi, Japan

[21] Appl. No.: 320,035

[22] Filed: Nov. 10, 1981

[30] Foreign Application Priority Data

Nov. 27, 1980 [JP] Japan ..... 55-170865[U]

[51] Int. Cl.[3] ..... F04B 1/16; F16N 7/00

[52] U.S. Cl. ..... 417/269; 92/159; 92/71

[58] Field of Search ..... 91/499, 502; 417/269; 74/60; 92/153, 159

[56] References Cited

U.S. PATENT DOCUMENTS

| | | | |
|---|---|---|---|
| 2,237,989 | 4/1941 | Hermann | 74/60 |
| 2,277,496 | 3/1942 | Maines | 74/60 |
| 3,933,082 | 1/1976 | Moley | 91/488 |
| 3,968,699 | 7/1976 | Cornelius | 91/499 |
| 4,212,230 | 7/1980 | Eikmann | 92/159 |
| 4,360,321 | 11/1982 | Copp | 417/269 |
| 4,364,306 | 12/1982 | Hattori | 417/269 |

FOREIGN PATENT DOCUMENTS

| | | | |
|---|---|---|---|
| 2384439 | 10/1978 | France | 91/499 |

*Primary Examiner*—William L. Freeh

*Attorney, Agent, or Firm*—Sughrue, Mion, Zinn, Macpeak & Seas

[57] ABSTRACT

A swash plate type compressor, having a swash plate fixedly and slantingly secured to a drive shaft and also secured to pistons in such a manner that the pistons reciprocate as the swash plate rotates, has piston webs which have a sliding outer surface and a relief inner surface. A clearance exists between a circumferential surface of the swash plate and the relief surface which creates a wedge effect which, in turn, produces a lubricating film pressure that substantially reduces wear between the circumferential surface of the swash plate and the sliding surface.

8 Claims, 7 Drawing Figures

SWASH PLATE TYPE COMPRESSOR

BACKGROUND OF THE INVENTION

1. Field of the Invention

The present invention relates to swash plate type compressors suitable for air-conditioning of vehicles, and more particularly to a technique for preventing the sliding surfaces of the swash plate and the piston webs in such a compressor from becoming excessively worn.

2. Description of the Prior Art

In a swash plate type compressor, pistons reciprocating in cylinder bores are mounted over a swash plate which is fixedly secured to a drive shaft in such a manner as to be slanting with respect to the drive shaft. The pistons are coupled to the swash plate through bearing means comprising shoes and balls. Furthermore, in general, as shown in FIG. 6, a sliding surface or contact surface 20 of each piston web 19, which confronts a circumferential surface of the swash plate, has a curvature substantially equal to that of the circumferential surface of the swash plate. When the swash plate 22 rotates in the direction of the arrow P in FIG. 6, because of the rotational movement of the piston 16 caused by the rotation of the shoes 23 and the balls 24, the piston web 19 which is positioned at the rear side in the direction of rotation of the swash plate 22, i.e., the left-hand piston web 19 in FIG. 6, is more forcefully brought into contact with the circumferential surface of the swash plate. In this case, the outer portion of the piston web 19 contacts the circumferential surface of the swash plate as shown in FIG. 7(*a*), or the inner portion contacts it as shown in FIG. 7(*b*). In the former case as shown in FIG. 7(*a*), a wedge effect can be obtained during the period of initial use after the compressor has been assembled. However, as the piston web is worn, the wedge effect is eliminated. On the other hand, in the latter case where the inner portion contacts with the circumferential surface of the swash plate, no wedge effect can be obtained, and the rotational movement of the piston cannot be sufficiently supported.

Thus, in the conventional swash plate type compressor, the sliding surfaces of the piston webs, which are slidably brought into contact with the circumferential surface of the swash plate, are not sufficiently lubricated, as a result of which metal contact takes places to quickly wear these components. In particular, when the swash plate and the pistons are made of aluminum, they are worn very fast.

SUMMARY OF THE INVENTION

Accordingly, an object of the present invention is to provide an improved swash plate type compressor in which the above-described difficulties accompanying a conventional swash plate type compressor have been eliminated;

It is a further object to provide a swash plate type compressor wherein a wedge effect is fully utilized for lubricating piston webs;

It is yet a further object to provide a compressor wherein the amount of wear of the sliding surfaces of the piston webs and the swash plate are reduced along with the amount of noise generated.

These and other objects of the present invention are attained by providing the piston webs of a swash plate type compressor with a relief surface and a sliding surface, the relief surface forming the inner surface of the piston web and the sliding surface forming the outer surface of the piston web. A predetermined clearance is provided between the relief surface and the circumferential surface of the swash plate thereby producing film pressure due to a wedge effect as the swash plate rotates. The resulting film pressure provides lubrication between the sliding surface of the piston web and the circumferential surface of the swash plate which reduces wear, reduces the power loss due to friction, and reduces noise.

DESCRIPTION OF THE PREFERRED EMBODIMENTS

Figure 1:
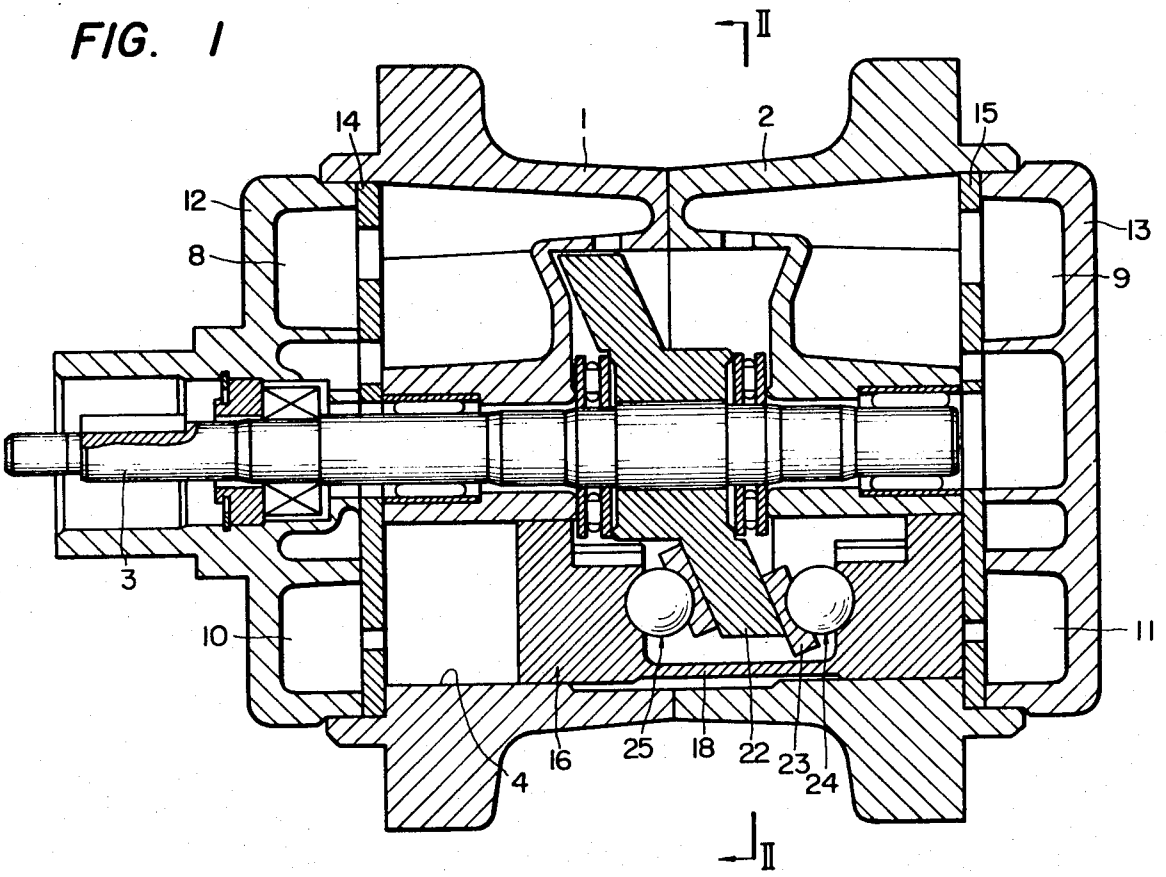
FIG. 1 is a longitudinal sectional view of one example of a swash plate type compressor according to the present invention.
Figure 2:
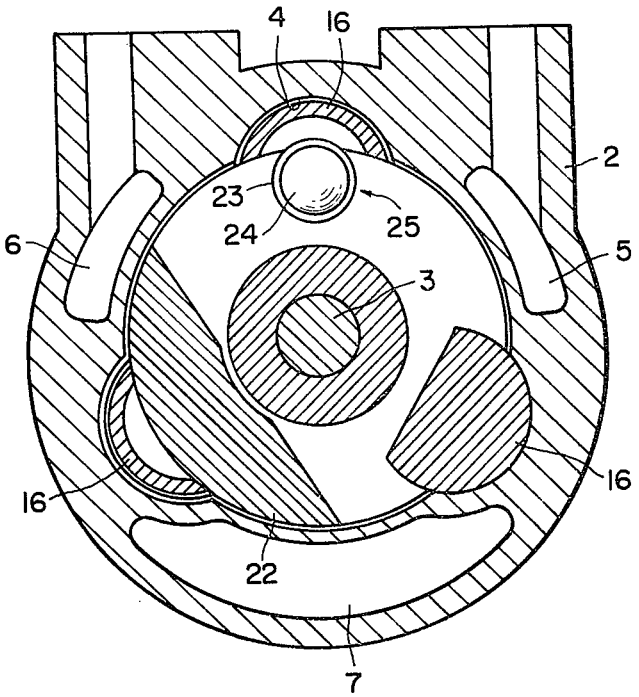
FIG. 2 is a sectional view taken along line II—II in FIG. 1.
Figure 3:
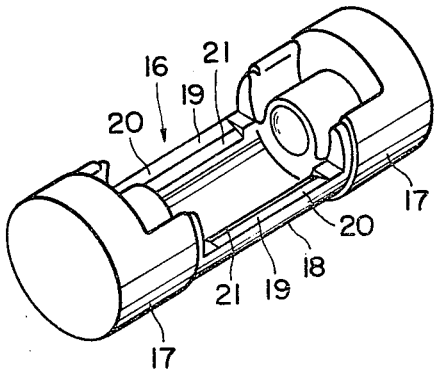
FIG. 3 is a perspective view of a piston in the compressor shown in FIG. 1.

One embodiment of the present invention will be described with reference to the accompanying drawings. Referring to FIGS. 1 and 2, a pair of cylinder blocks 1 and 2 are assembled together to form several (three in the embodiment) cylinder bores 4 which are parallel with a drive shaft 3 which extends along the axis of the cylinder blocks 1, 2. An inlet passage 5, an outlet passage 6 and an oil accumulation chamber 7 are formed in the portions of the blocks where the bores 4 are formed. Front and rear housings 12 and 13 have inlet chambers 8 and 9 and outlet chambers 10 and 11, respectively, and are mounted through valve plates 14 and 15 on the ends of the cylinder blocks 1 and 2, respectively.

A piston 16 is reciprocatably fitted in each of the cylinder bores 4. The piston 16 has piston units 17 at both ends. The piston 16 is arranged in such a manner that the middle of the piston 16, namely a coupling portion 18 substantially semicircular in section through which the two piston units 17 are coupled together, is mounted over a swash plate 22 which is fixedly mounted on the middle portion of the drive shaft 3. The swash plate 22 is slanting with respect to the axis of the drive shaft 3. Furthermore, the piston 16 is coupled to both sides of the peripheral portion of the swash plate 22 through bearing members 25 each consisting of a shoe 23 and a ball 24. The coupling portion 18 of the piston 16 has webs 19 at both ends in the circumferential direction. The webs 19 are slidably confronted with the circumferential surface of the swash plate 22.

Figure 4:
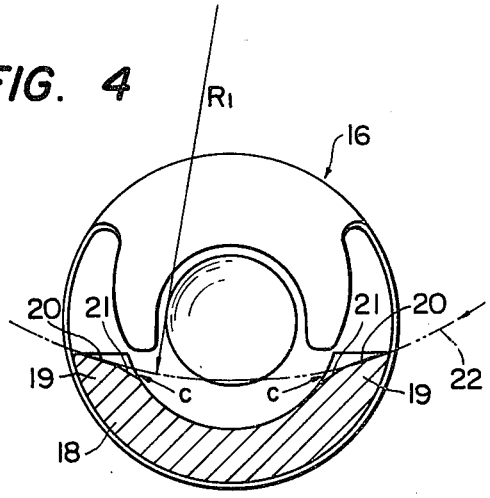
FIGS. 4 and 5 are sectional views showing examples of a piston web which is one of the essential components of the compressor according to the present invention.
Figure 5:
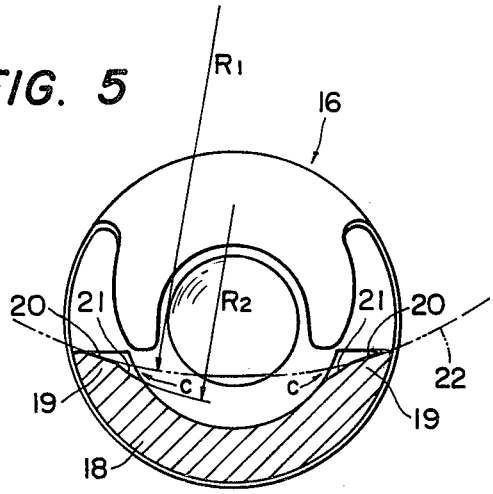
Figure 6:
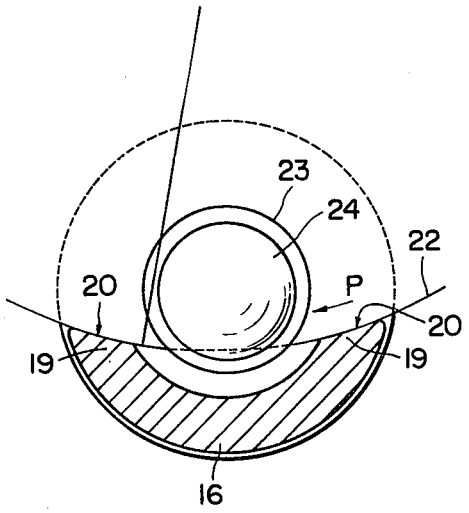
FIG. 6 is a sectional view showing a piston web in a conventional swash plate type compressor.
Figure 7A:
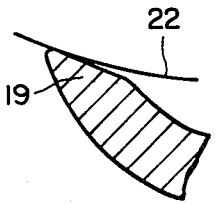
FIG. 7 is an explanatory diagram showing states of a piston web which are in contact with the circumferential surface of a swash plate in the conventional compressor.
Figure 7B:
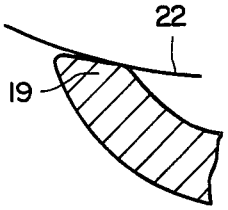

Each of the surfaces of the webs 19 which confront the circumferential surface of the swash plate comprises an inner surface 21 and an outer surface 20. The outer surface is formed into a sliding surface 20 having a radius of curvature $R_1$ which is substantially equal to the radius of curvature of the circumferential surface of the swash plate. The clearance C between the inner surface 21 and the circumferential surface of the swash plate increases gradually inwardly; that is, the inner surface serves as a relief surface 21. The relief surface 21 may be formed by straightly chamfering the web as shown in FIG. 4, or it may be an arcuate surface having a radius of curvature $R_2$ which is smaller than that $R_1$ of the sliding surface 21 as shown in FIG. 5. In both cases, the width of the relief surface is at least 0.5 mm (slightly smaller than the width of the sliding surface 20) and the relief surface is lower by at least 5μ, preferably 30 to 100μ, than the sliding surface 20 at the inner end.

The formation of the relief surface 21 only on the web 19 which is positioned at the rear side in the direction of rotation of the swash plate 22 is sufficient for the operation of the compressor of the present invention. However, it is advantageous to form the relief surface 21 on each of the webs 19, so that it is unnecessary to pay attention to the orientation of each piston 16 during the assembling work. In the case where the relief surface 21 is formed by casting a chill layer is created. Therefore, the forming of the relief surface by casting creates superior wear resistance and mechanical strength than forming the relief surface by machining.

The swash plate type compressor of the present invention is constructed as described above. Therefore, when the swash plate 22 is rotated to cause the pistons 16 to reciprocate in the cylinder bores 4, the rotation of each piston 16 is prevented as the sliding surface 20 of the web 19 is abutted against the circumferential surface of the swash plate 22. In this operation, as the shoes 23 and the balls 24 rotate with the rotation of the swash plate 22, the sliding surface 20 of one of the webs 19 which is located at the rear side in the direction of rotation of the swash plate 22 is strongly abutted against the circumferential surface of the swash plate 22.

Under this abutment condition, a predetermined clearance C is maintained between the circumferential surface of the swash plate 22 and the relief surface 21 which is formed inwardly of the sliding surface 20. Therefore, oil is positively drawn. In addition, because of the wedge effect, a film pressure is readily produced. Thus, direct metal contact between the sliding surfaces 20 and the circumferential surface of the swash plate is prevented, so that the wear of the piston web 19 is minimized. Since the lubrication effect is large, the loss of power due to the friction of the circumferential surface of the swash plate is reduced. Therefore, the pressure on the piston side is decreased, and the loss of power and the wear in the sliding surfaces of the piston 16 and the cylinder bores 4 can be effectively reduced. As the wear of the piston web is reduced as described above, the clearance between the piston web 19 and the circumferential surface of the swash plate is not excessively increased which minimizes the generation of noise.

As was described above, according to the present invention, the inner portion of the sliding surface of each piston web which together with the circumferential surface of the swash plate forms a sliding section, is formed into a relief surface, so that the predetermined clearance is provided between the relief surface and the circumferential surface of the swash plate, as a result of which the lubrication effect on the sliding surface is considerably improved. Therefore, the wear of the sliding section is reduced, and the service life is increased. Since the clearance between the relief surface and the swash plate circumferential surface increases gradually inwardly, even as the sliding surface becomes worn, the wedge effect remains unchanged, which provides the lubrication effect at all times, thus preventing the contact surface of the sliding surface from being increased. Furthermore, the compressor according to the present invention can be readily manufactured.

What is claimed:

1. A swash plate type compressor having a swash plate fixedly secured to a drive shaft in such a manner that said swash plate is slanting with respect to said drive shaft, and pistons coupled through bearing means to said swash plate in such a manner that said pistons are reciprocated with the rotation of said swash plate, comprising:

a sliding surface formed on a web of each piston, said sliding surface slidably confronting a circumferential surface of said swash plate, said sliding surface having a curvature substantially equal to that of said circumferential surface of said swash plate, and;

a relief surface formed on said web next to said sliding surface, said relief surface being on inner surface of said web and said sliding surface being an outer surface of said web, said relief surface being formed so that a clearance between said relief surface and said circumferential surface of said swash plate increases gradually inwardly.

2. The compressor of claim 1 wherein said relief surface is a cast, unmachined surface, formed to have a chill layer to increase its strength and wear resistance.

3. The compressor claimed in claim 1, wherein said relief surface is formed by casting without subsequent machining.

4. The compressor claimed in claim 1 wherein said relief surface is a slanting straight surface.

5. The compressor claimed in claim 1 wherein said relief surface is an arcuate surface having a radius smaller than a radius of said circumferential surface of said swash plate.

6. The compressor claimed in claim 4 or 5, wherein each piston has two webs and each web has a sliding surface and a relief surface.

7. The compressor claimed in claim 6 wherein a width of said relief surface is smaller than a width of said sliding surface.

8. The compressor claimed in claim 7 wherein one inner end of said relief surface is between 30μ and 100μ lower than an inner end of said sliding surface.

* * * * *